US005595448A

United States Patent [19]

Harada

[11] Patent Number: 5,595,448

[45] Date of Patent: Jan. 21, 1997

[54] CARRIAGE SHIFTING APPARATUS AND SERIAL RECORDING SYSTEM

[75] Inventor: Toshiaki Harada, Kawasaki, Japan

[73] Assignee: Canon Kabushiki Kaisha, Tokyo, Japan

[21] Appl. No.: 498,138

[22] Filed: Jul. 5, 1995

Related U.S. Application Data

[63] Continuation of Ser. No. 331,153, Oct. 28, 1994, abandoned, which is a continuation of Ser. No. 227,697, Apr. 14, 1994, abandoned, which is a continuation of Ser. No. 78,067, Jun. 18, 1993, abandoned, which is a continuation of Ser. No. 903,927, Jun. 26, 1992, abandoned.

[30] Foreign Application Priority Data

Jun. 28, 1991 [JP] Japan ..... 3-184034

[51] Int. Cl.[6] ..... B41J 25/304

[52] U.S. Cl. ..... 400/320; 400/319; 400/322; 400/335

[58] Field of Search ..... 400/319, 320, 400/322, 335; 242/155 R

[56] References Cited

U.S. PATENT DOCUMENTS

| | | | |
|---|---|---|---|
| 4,313,124 | 1/1982 | Hara | 346/140 |
| 4,345,262 | 8/1982 | Shirato et al. | 340/140 R |
| 4,403,877 | 9/1983 | Jones et al. | 400/335 |
| 4,459,600 | 7/1984 | Sato et al. | 346/140 R |
| 4,463,359 | 7/1984 | Ayata et al. | 340/140 R |
| 4,558,333 | 12/1985 | Sugitani et al. | 340/140 R |
| 4,570,874 | 2/1986 | Iakeda | 242/155 R |
| 4,723,129 | 2/1988 | Endo et al. | 346/140 R |
| 4,740,796 | 4/1988 | Endo et al. | 340/140 R |
| 4,746,237 | 5/1988 | Takeda . | |
| 4,760,992 | 8/1988 | Peppel et al. | 242/155 R |
| 4,883,445 | 11/1989 | Gomoll et al. . | |
| 4,991,984 | 2/1991 | Fare' | 400/320 |
| 5,098,209 | 3/1992 | Gomoll et al. | 400/320 |
| 5,133,614 | 7/1992 | Buschmann et al. | 400/320 |

FOREIGN PATENT DOCUMENTS

| | | |
|---|---|---|
| 0349814 | 1/1990 | European Pat. Off. . |
| 54-056847 | 5/1979 | Japan . |
| 59-123670 | 7/1984 | Japan . |
| 59-138461 | 8/1984 | Japan . |
| 60-071260 | 4/1985 | Japan . |
| 62-220341 | 9/1987 | Japan . |
| 1176565 | 7/1989 | Japan . |

*Primary Examiner*—John S. Hilten

*Attorney, Agent, or Firm*—Fitzpatrick, Cella, Harper & Scinto

[57] ABSTRACT

The present invention provides a carriage shifting apparatus comprising a drive source, a suspension member suspended to transmit a driving force of the drive source, a carriage connected to the suspension member and reciprocally shiftable by the driving force of the drive source, a tension applying means for applying a tension force to the suspension member, and a weight body attached to the tension applying means via a viscoelastic member.

11 Claims, 5 Drawing Sheets

498

CARRIAGE SHIFTING APPARATUS AND SERIAL RECORDING SYSTEM

This application is a continuation of application Ser. No. 08/331,153, filed Oct. 28, 1994, which is a continuation of application Ser. No. 08/227,697, filed Apr. 14, 1994, which is a continuation of application Ser. No. 08/078,067, filed Jun. 18, 1993, which is a continuation of application Ser. No. 07/903,927, filed Jun. 26, 1992, all now abandoned.

BACKGROUND OF THE INVENTION

1. Field of the Invention

The present invention relates to a carriage shifting apparatus wherein a carriage is shifted by transmitting a driving force to the carriage via pulleys and a belt or rope, and a serial recording system utilizing such carriage shifting apparatus.

2. Related Background Art

In the past, as systems which are operated by reciprocally shifting a carriage, serial recording systems and original (document) readers of serial type are well known. For example, in such serial recording systems, as shown in FIG. 7, a recording head 51 is mounted on a carriage 50 and an image such as a character is recorded on a recording medium 52 by serially scanning the carriage 50. Further, in the conventional serial original readers, an image sensor (in place of the recording head 51) is mounted on the carriage 50 and an image is read by serially scanning the carriage 50. Conventionally, in order to serially scan the carriage 50, generally, the carriage 50 is connected to an endless timing belt 56 extending between and mounted around a driving pulley 54 connected to a motor 53 and a driven pulley 55, and the carriage 50 is reciprocally shifted along a guide rail 57 by driving the motor 53 in normal and reverse directions alternately. Incidentally, in order to apply a tension force to the timing belt 56, a support plate 58 for supporting the driven pulley 55 is pivotally mounted on a shaft 59 and the support plate 58 is biased by a tension spring 60 to apply a tension force to the belt 56.

With the above-mentioned arrangement for serially scanning the carriage, (1) when the total weight of the carriage 50 is increased (for example, when the number of the recording heads 51 mounted on the carriage is increased or when the capacity of the recording head is increased) and/or (2) when a shift stroke of the carriage 50 is increased (for example, when a size of the recording medium to be recorded or a size of an original to be read is great) and/or (3) when a scanning speed is increased, an output torque of the motor 53 is increased and the tension to the belt is also increased.

However, generally, if the output torque of the motor 53 is increased, the greater vibration of the belt 56 will occur, thus generating greater noise. Particularly, when a stepping motor is used as the drive motor, this phenomenon will be more noticeable. Further, as the weight of the carriage 50 is increased, when the carriage is rapidly accelerated from a stopped condition to a steady state or when the carriage is rapidly stopped from the steady state to the stopped condition, the shock vibration will occur, thus easily generating the noise. For these reasons, the increase in the mounting ability of the carriage 50 and the increase in the scanning speed were limited.

SUMMARY OF THE INVENTION

The present invention aims to eliminate the above-mentioned conventional drawbacks, and an object of the present invention is to provide a carriage shifting apparatus and a serial recording system which can reduce the occurrence of the vibration during a scanning operation of a carriage and reduce the noise.

In order to achieve the above object, according to an aspect of the present invention, there is provided a carriage shifting apparatus comprising a drive source, a suspension member suspended for transmitting a driving force of the drive source, a carriage connected to the suspension member and reciprocally shiftable by driving the drive source, and a tension applying means for applying a tension force to the suspension member. Wherein a weight body is attached to the tension applying means via a viscoelastic member. The present invention also provides a serial recording system having such carriage shifting apparatus.

With this arrangement, during the shifting movement of the carriage, the vibration and noise due to the shifting movement of the carriage can be effectively reduced by the viscoelastic member and the weight member.

DESCRIPTION OF THE PREFERRED EMBODIMENTS

The present invention will now be explained in connection with embodiments thereof with reference to the accompanying drawings.

First of all, an embodiment wherein the present invention is applied to an ink jet serial recording system will be described.

Figure 1:
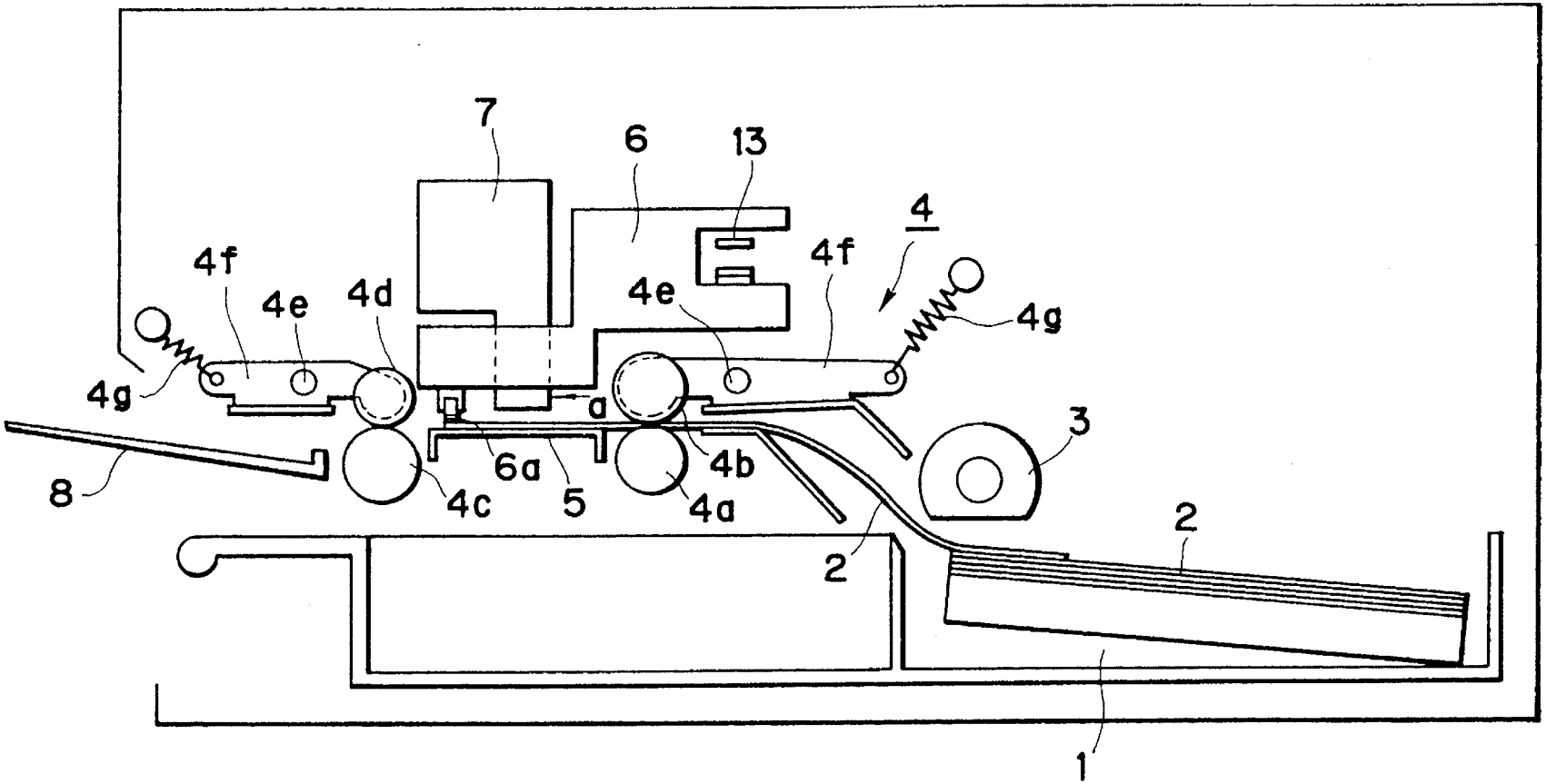
FIG. 1 is an elevational sectional view of a serial recording system according to a preferred embodiment of the present invention.
Figure 2:
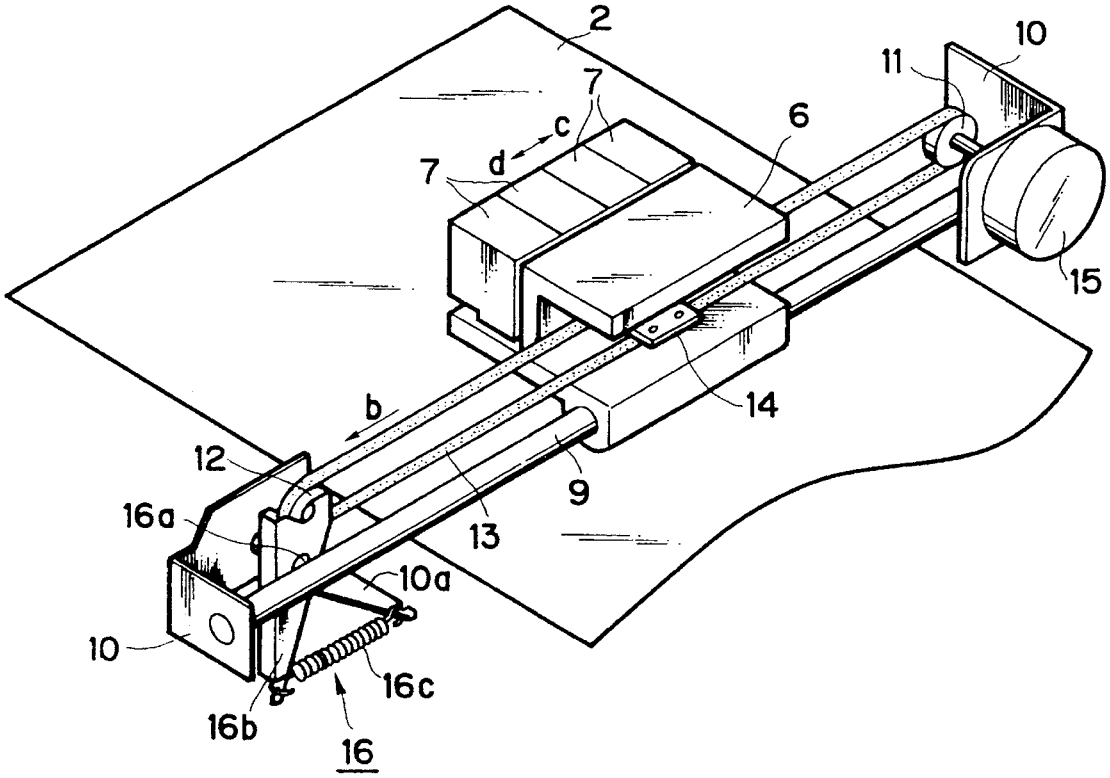
FIG. 2 is a perspective view of an carriage shifting apparatus.

FIG. 1 is an elevational sectional view of the serial recording system, and FIG. 2 is a perspective view of a carriage shifting apparatus of the serial recording system.

As shown in FIG. 1, the recording system is designed so that recording media (sheets) 2 stacked in a cassette 1 are picked up and supplied one by one by a pick-up roller 3, the supplied recording sheet is fed by a sheet feeding means 4, a carriage 6 is scanned along the recording sheet 2 backed-up by a platen 5 (in directions perpendicular to the plane of FIG. 1), the recording is performed by activating a recording head (recording means) 7 mounted on the carriage 6, and the recorded sheet 2 is ejected onto an ejection tray 8.

Next, each of the constructural elements of the recording system will be fully explained.

(Sheet Feeding Means)

As shown in FIG. 1, the sheet feeding means 4 is constituted by a feed roller 4*a* and a pinch roller 4*b* which cooperate to feed the recording sheet 2 to a recording area, and an ejector roller 4*c* and a pinch roller 4*d* which cooperate to eject the recorded sheet 2 onto the ejection tray 8. The feed roller 4*a* and the ejector roller 4*c* are connected to a feed motor (not shown) to be driven thereby, and the pinch rollers 4*b*, 4*d* are mounted on one end of respective arms 4*f* pivotally mounted on respective shafts 4*e*. These pinch rollers 4*b*, 4*d* are urged against the feed roller 4*a* and the ejector roller 4*c*, respectively, by respective springs 4*g* connected to the other ends of the respective arms 4*f*. With this arrangement, when the feed motor is driven, the recording sheet 2 is fed in a direction shown by the arrow a in FIG. 1.

Incidentally, a driving force is transmitted to the ejector roller 4*c* in such a manner that the latter is rotated at a speed faster than that of the feed roller 4*a* by about 2–3%, so that a moderate tension force is applied to the recording sheet 2 being fed.

(Carriage Shifting Apparatus)

The carriage 6 is shiftably and rotatably mounted on a guide rail 9 shown in FIG. 2. Now, a mechanism for reciprocally shifting the carriage 6 along the guide rail 9 will be described.

Figure 3:
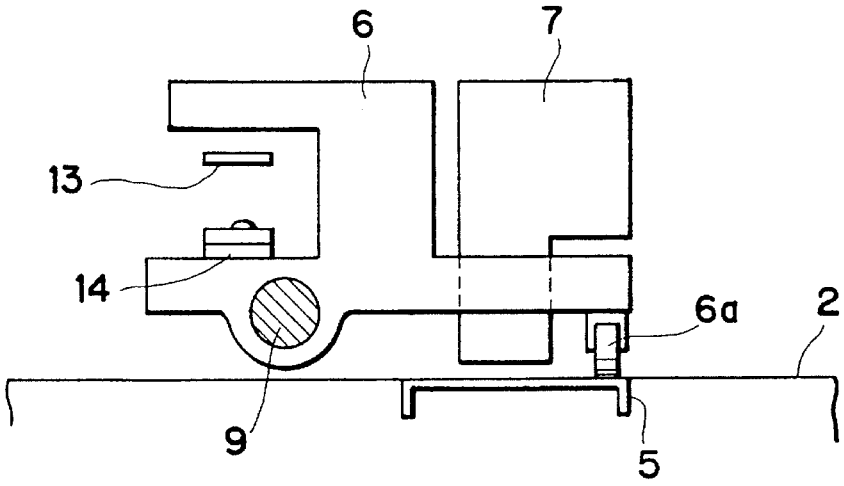
FIG. 3 is an end view of the carriage.

A driving pulley 11 and a driven pulley 12 are mounted on a chassis 10 by which both ends of the guide rail are supported. An endless timing belt 13 acting as a suspension member extends between and is wound around the pulleys 11, 12. The timing belt 13 is connected to the carriage 6 by a fastening member 14, and a carriage motor 15 serving as a drive source for shifting the carriage 6 is connected to the driving pulley 11. Further, as shown in FIG. 3, a heading or positioning roller 6*a* is mounted on a lower end of the carriage 6. This roller 6*a* is contacted with the recording sheet 2 supported on the platen 5 to keep a distance between an ink discharge surface of the recording head 7 and the recording sheet 2 constant.

Figure 4:
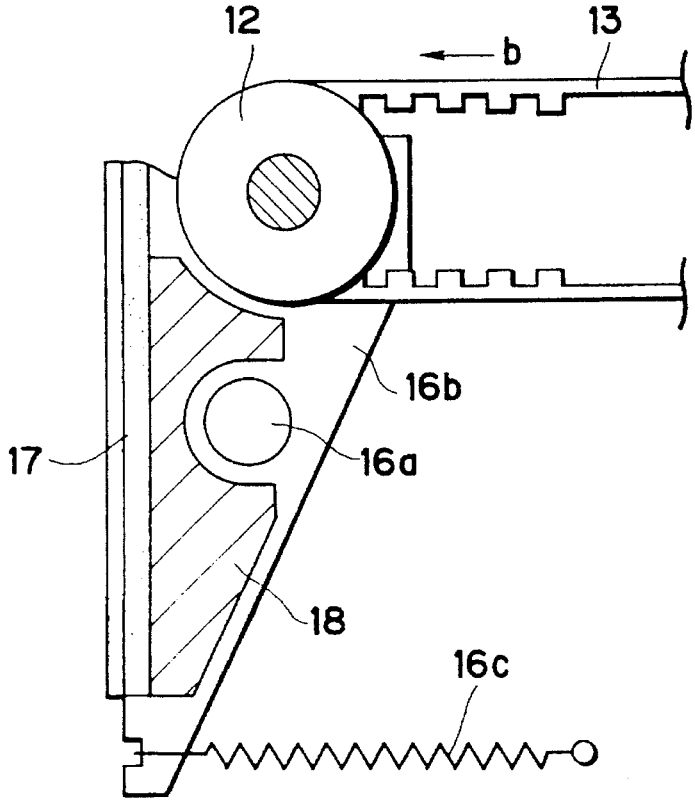
FIG. 4 is a view showing a condition that a viscoelastic member and a weight body are attached to tension applying means.

Further, a constant tension force is applied to the timing belt 13 by a tension applying means 16. More particularly, as shown in FIGS. 2 and 4, a tensioner plate 16*b* is pivotally mounted on the chassis 10 via pin 16*a*, and the driven pulley 12 is rotatably mounted on an upper end of the tensioner plate 16*b*. Further, a tension spring 16*c* is arranged between a lower end of the tensioner plate and a locking hook 10*a* of the chassis 10. With this arrangement, the driven pulley 12 is biased toward a direction shown by the arrow b, thus applying a tension force to the timing belt 13.

Further, as shown in FIG. 4, a viscoelastic member 17 is attached to the tensioner plate 16*b*, and a weight body 18 is attached to the viscoelastic member 17. Incidentally, in this embodiment, the viscoelastic member 17 comprises a vibration suppressing sheet (made by Nihon Tokushu Toryo Co., Ltd. as EDKEL M5000 (Trademark)) having a thickness of about 2 mm and a weight of about 3 grams and is adhered to the tensioner plate 16*b*, and a lead block having a weight of about 60 grams is adhered to this sheet by a double-sided adhesive tape as the weight body 18.

(Recording Means)

A recording means serves to record an ink image on the recording sheet 2 fed by the sheet feeding means 4. In this recording system, an ink jet recording means is used as the recording means. In this embodiment, as shown in FIG. 2, four recording heads 7 integrally including respective ink tanks are mounted on the carriage 6, and a color image is recorded on the recording sheet 2 by discharging yellow, magenta, cyan and black ink droplets from the recording heads in response to image signals synchronously with the scanning of the carriage 6.

Each recording head 7 is provided with fine liquid discharge openings (orifices), liquid passages, energy acting portions associated with portions of the corresponding liquid passages, and energy generating means for generating liquid droplet forming energy which acts on the liquid contacting with the corresponding acting portion. Such discharge energy generating means may be, for example, an energy generating means using electrical/mechanical converters such as piezo-electric elements, an energy generating means for discharging liquid droplets by heating the liquid by the electro-magnetic wave such as laser, or an energy generating means for discharging liquid by heating the liquid by means of electrical/thermal converters. Among them, the ink jet recording-heads for discharging the liquid by means of the thermal energy can form the image with high resolving power, since the discharge openings can be arranged with high density. Further, among them, the recording head using the electrical/ thermal converters as the energy generating means is advantageous, since it can be small-sized, the merits of IC techniques and/or micro-working techniques which have recently been remarkably progressed and been more reliable in the semi-conductor field can be effectively utilized, it can be assembled with high density, and the manufacturing cost of the head can be reduced.

(Noise Reduction Function)

Next, the vibration decreasing and noise reducing function during the recording operation of the recording system having the above construction will be explained.

When the recording operation is performed, the carriage 6 is shifted from a home position at a left end in FIG. 2 in a direction shown by the arrow c to effect the recording (normal scan), then is stopped at a right end of FIG. 2, then is shifted in a direction shown by the arrow d (reverse scan) by reversely rotating the carriage motor 15, and then is returned to the home position.

Figure 5:
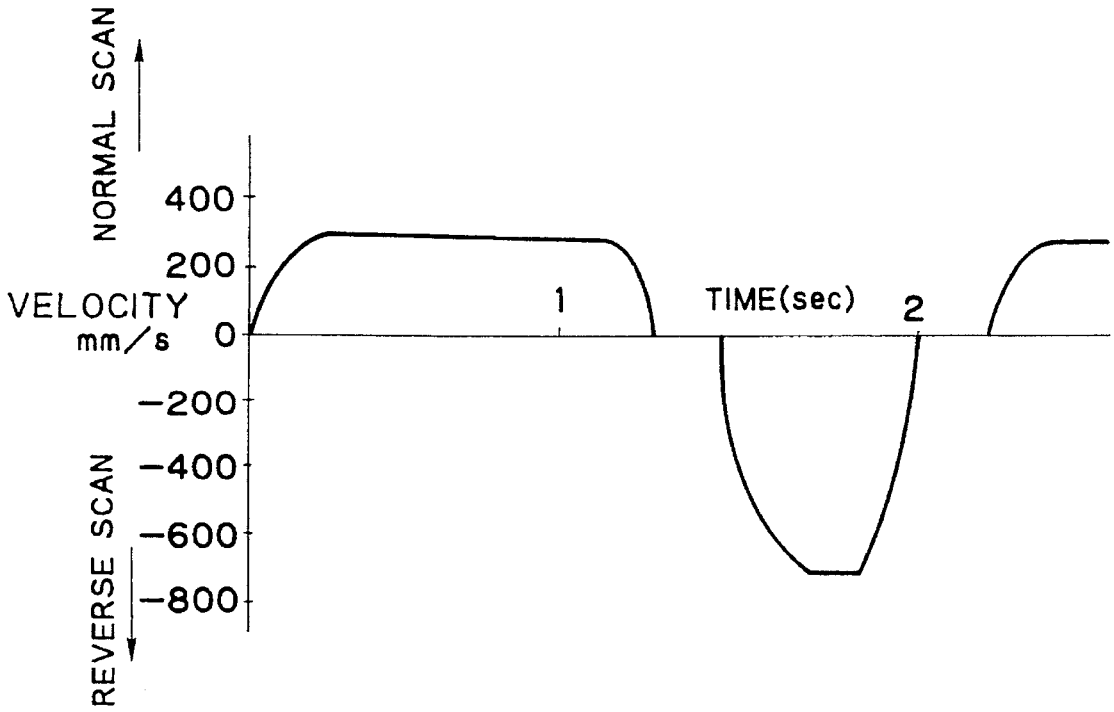
FIG. 5 is a graph showing acceleration and deceleration conditions of the normal scan and reverse scan of the carriage.

Now, the carriage 6 is driven at a shifting speed on the basis of a speed curve shown in FIG. 5. Generally, when the recording is effected only in the normal scanning direction, the carriage returning speed in the reverse scanning direction is increased more than the carriage speed in the normal scanning direction by several times to reduce the total recording time. Also in this embodiment, the carriage returning speed is set to have a value more than that of the carriage speed in the normal scanning direction by about three times.

In this case, although the carriage 6 is driven so that a building-up speed of the carriage 6 becomes as gentle as possible, as the position of the carriage may be, the timing belt 13 acts like a cord of a bow to generate the tension shock, thus easily causing the vibration. Such vibration is apt to generate at the start of the shifting of the carriage (acceleration for start) in the normal and reverse scans. Particularly, at the start of the reverse scan, since the rapid acceleration generates and a free length (length of the belt portion which is not contacted with any members) of the timing belt 13 is longest when the carriage is at the right end position of FIG. 2, the belt generates the tension shock as the cord of the bow, thus easily causing the vibration and noise.

Figure 6:
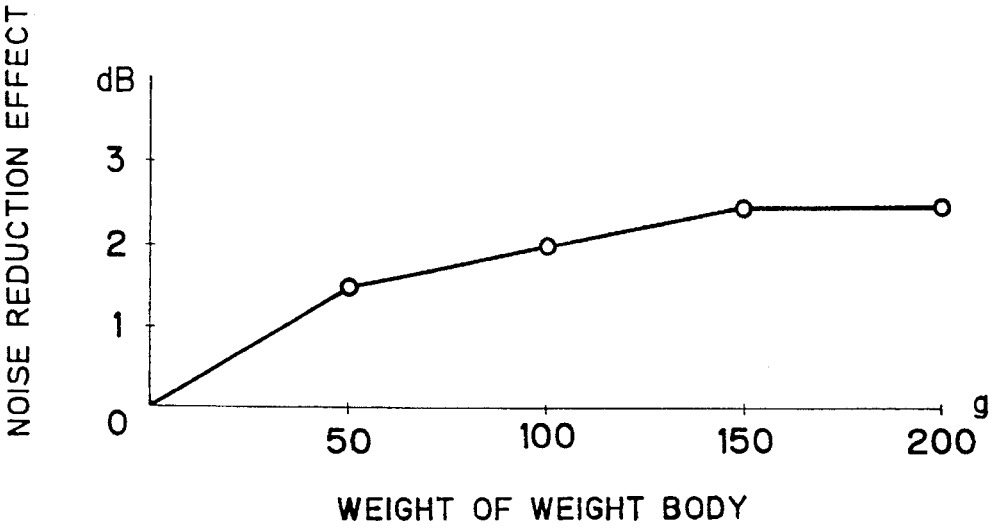
FIG. 6 is a graph showing a test result indicating the noise reduction effect.
Figure 7:
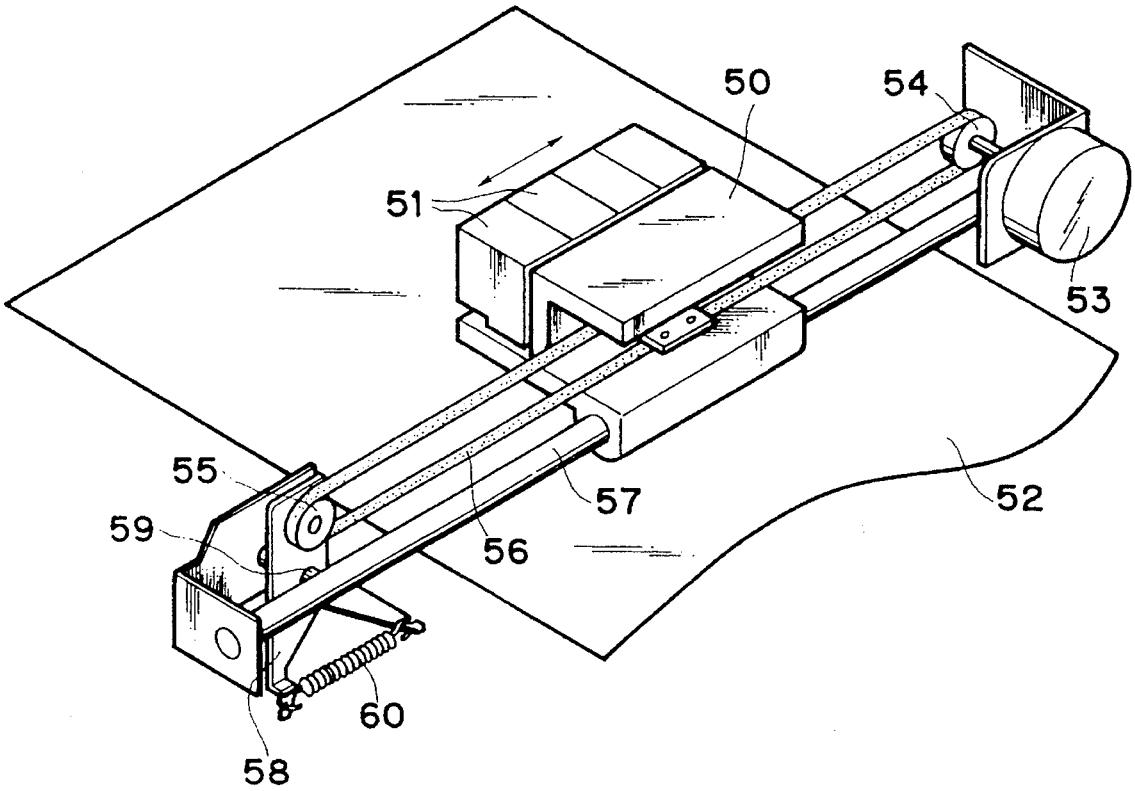
FIG. 7 is a perspective view of a conventional carriage shifting apparatus.

However, when the viscoelastic member 17 and the weight body 18 are attached to the tensioner plate 16*b* as in the illustrated embodiment of the present invention, as shown in the test result of FIG. 6, the vibration is decreased and the noise is reduced by about 2 dB in comparison with the case where there are no viscoelastic member 17 and weight body 18. The reason seems to be that, by providing the viscoelastic member 17 and the weight body 18, the tensioner plate 16*b* functions as if a tensioner plate having a vibration absorber comprising "spring and weight mass", so that the vibration transmitted to the tensioner plate 16*b* is decreased to reduce the noise.

FIG. 6 shows a test result wherein an amount of the noise reduction in comparison with the conventional cases was sought as a function of weight of the weight body 18. As apparent from the test result, as the weight of the weight body 18 increased, the noise was decreased, and when the weight of the weight body became more than 150 grams, the noise reduction effect became substantially constant. From the above test result, it is effective that the weight of the weight body 18 is set to 30–300 grams. Particularly, when the weight of the weight body 18 becomes more than 50 grams, the noise is decreased by more than 2 dB so that the noise reduction effect can be audibly noticed or ascertained, and thus, the conventional discordant noise can be clearly decreased.

According to the test results, by attaching the viscoelastic member 17 and the weight body 18 to the tensioner plate 16*b*, the noise reduction effect of about 2 dB can be achieved, and, when a further degree of freedom in design is permitted, the noise reduction effect of about 3 dB can be expected. Incidentally, it was found from the test that, when the weight body 18 was directly secured to the tensioner plate 16*b*, the noise reduction effect could not be obtained, and, when the weight body 18 was adhered to the tensioner plate 16*b* by the double-sided adhesive tape, the noise was decreased slightly. Further, when the weight of the weight body 18 was greater than that of the viscoelastic member 17 by several to several hundred times, the noise reduction effect could be obtained.

From the above, in the present time, although it is not clear why the noise is decreased, the reason why the noise is decreased by attaching the weight body 18 to the tensioner plate 16*b* via the viscoelastic member 17 seems to be that the vibration of the tensioner plate 16*b* is decreased to reduce the noise by the same effect as a tensioner plate having the vibration absorber as mentioned above, rather than that the vibration is decreased by viscous resistance of the viscoelastic member 17 such as a so-called vibration suppressing sheet.

Incidentally, in the above-mentioned embodiment, while an example in which the vibration suppressing sheet available in the market is used as the viscoelastic member 17 was explained, the viscoelastic member 17 is not limited to the vibration suppressing sheet, but may be made of, for example, vibration isolating rubber material or general rubber material, adhesive tapes such as a double-sided adhesive tape, or polymer material having viscoelasticity, which are grouped as a so-called viscoelastic material or vibration isolating material and which can stably hold the weight body 18.

Further, in the illustrated embodiment, while an example in which the lead block is used as the weight body 18 was explained, because lead is a practical metal having high specific gravity in consideration of the installation space, the weight body 18 is not limited to the lead block, but may be made of, for example, other metals such as stainless steel, copper, brass or aluminium, or a non-metallic material such as resin, and may be appropriately selected in consideration of the installation space, cost, usage and the like.

Furthermore, in the illustrated embodiment, while an example in which the carriage shifting apparatus is used with the serial recording system wherein the recording head 7 is mounted on the carriage 6 was explained, the carriage shifting apparatus may be used with an original reading system wherein a reading means for reading image information on an original is mounted on a carriage, with the same function and advantage.

Further, in the illustrated embodiment, while an example in which the ink jet recording system is used as the recording means was explained, the recording means is further preferably designed that ink is discharged by the growth of bubble caused by the film boiling of ink generated by selectively energizing electrical/thermal converters in response to a record signal.

It is preferable to employ the typical structure and the principle of structures disclosed in, for example, U.S. Pat. No. 4,723,129 and U. S. Pat. No. 4,740,796. This system can be adopted in so-called "On-Demand" type and "Continuous" type structures. In this system, an electrothermal conversion member disposed to align to a sheet or a liquid passage in which liquid (ink) is held is supplied with at least one drive signal which corresponds to information to be recorded and which enables the temperature of the electrothermal conversion member to be raised higher than a nucleate boiling point, so that thermal energy is generated in the electrothermal conversion member and film boiling is caused to take place on the surface of the recording head which is heated. As a result, bubbles can be respectively formed in liquid (ink) in response to the drive signals. Due to the enlargement and contraction of the bubble, liquid (ink) is discharged through the discharge port, so that at least one droplet is formed. In a case where the aforesaid drive signal is made to be a pulse signal, a further satisfactory effect can be obtained in that the bubble can immediately and properly be enlarged/contracted and liquid (ink) can be discharged while exhibiting excellent responsiveness.

It is preferable to employ a drive signal of the pulse signal type disclosed in U.S. Pat. No. 4,463,359 and U.S. Pat. No. 4,345,262. Furthermore, in a case where conditions for determining the temperature rise ratio on the aforesaid heated surface disclosed in U. S. Pat. No. 4,313,124 are adopted, a further excellent recording operation can be performed.

In addition to the structure (a linear liquid passage or a perpendicular liquid passage) of the recording head formed by combining the discharge ports, the liquid passage and the electrothermal conversion member as disclosed in the aforesaid specifications, a structure disclosed in U. S. Pat. No. 4,558,333 and U.S. Pat. No. 4,459,600 in which the heated portion is disposed in a bent portion is included in the scope of the present invention.

Further, even when a plurality of electrical/ thermal converters are constructed on the basis of the technique disclosed in the Japanese Patent Laid-Open Appln. No. 59-123670 describing the construction wherein a common slit is disposed at discharge portions of electrical/thermal converters or the technique disclosed in the Japanese Patent Appln. Laid-Open No. 59-138461 describing the construction wherein openings for absorbing pressure waves due to thermal energy are disposed at the discharge portions, the present invention can be effectively carried out. That is to say, according to the present invention, regardless of the configuration of the recording head, it is possible to surely perform the recording efficiently.

In addition, among the above-mentioned serial types, the present invention is effectively applicable to a recording head secured to the carriage, a removable recording head of chip type wherein, when mounted on the carriage, electrical connection between it and the recording system and the supply of ink from the recording system can be permitted, or to a recording head of cartridge type wherein an ink tank is integrally formed with the recording head as in the above-mentioned embodiment.

Further, it is preferable that a head recovering means and an auxiliary aiding means are added to the recording head according to the present invention, since the effect of the present invention is further stabilized. More concretely, these means include a capping means for capping the recording head, cleaning means, pressurizing or suction means, and an auxiliary heating means comprising electrical/thermal converters or other heating elements or the combination thereof. Further, it is effective for the stable recording to perform an auxiliary discharge mode wherein the ink discharge regardless of the recording ink discharge is effected.

Further, as to the kind and number of the recording heads to be mounted, each recording head may correspond to each different color ink, or a plurality of recording heads can be used for a plurality of inks having different colors and/or different densities. That is to say, for example, as recording modes of the recording system, not only a recording mode with a main color such as black alone can be implemented, but also a combination of plural colors provided by plural recording heads integrally formed.

Further, in the illustrated embodiment, while the ink was liquid, the ink may be solid in a room temperature or less, or may be softened at a room temperature. In the above-mentioned ink jet recording system, since the temperature control is generally effected in a temperature range from 30° C. to 70° C. so that the viscosity of the ink is maintained within a stable discharging range, the ink may be liquidized when the record signal is emitted. In addition, ink having a feature that is firstly liquidized by the thermal energy, such as solid ink which serves to prevent the increase in temperature by absorbing energy in changing the ink from the solid state to the liquid state or which is in the solid state in the preserved condition to prevent the vaporization of ink and which is liquidized into ink liquid to be discharged in response to the record signal comprising the thermal energy, or ink which has already been solidified upon reaching the recording medium, can also be applied to the present invention.

In such a case, the ink can be held in the liquid state or solid state in recesses or holes in a porous sheet as disclosed in the Japanese Patent Appln. Laid-Open Nos. 54-56847 and 60-71260, in confronting relation to the electrical/thermal converters. Incidentally, the above-mentioned film boiling principle is most effective for each ink.

Further, the above-mentioned ink jet recording head can be used as an image output terminal of an information processing system such as a computer, or with a copying machine combined with a reader, or with a facsimile system having the communication function.

Incidentally, while the ink jet recording head was used as the recording means, the recording means according to the present invention is not limited to the ink jet recording system, but may comprise a heat transfer recording means, heat sensitive recording means, or any other recording means other than a wire dot impact recording means.

As mentioned above, according to the present invention, since the weight body is attached, via the viscoelastic member, to the tension applying means of the carriage shifting apparatus, it is possible to decrease the vibration generated by the shifting movement of the carriage, thus reducing the noise. Particularly, when the carriage is used in a rapid speed change or rapid acceleration and deceleration condition or when a stepping motor is used as the drive source, the effective noise reduction can be attained Thus, it is possible to attain the speed-up of the apparatus and load bearing ability of the carriage which could not be attained in the conventional techniques. Further, since the apparatus is not complex and there is no need to use the large installation space, it is possible to design the apparatus with a wider degree of freedom, and the present invention can be effectively applied to existing apparatuses to prevent the vibration and noise therein.

What is claimed is:

1. A carriage mechanism for moving a head member along a sheet member, said mechanism comprising:

a carriage for holding the head member;

a belt member for moving said carriage in a moving direction;

a first pulley member for driving said belt member and being provided at one end of the mechanism relative to the moving direction of said carriage;

a second pulley member for supporting said belt member at the other end of the mechanism relative to the moving direction of said carriage;

a support member for supporting said second pulley member; and a vibration absorbing member for absorbing a vibration, said vibration absorbing member having a resilient member and a weight member, with said weight member being attached to said support member via said resilient member.

2. A carriage mechanism according to claim 1, wherein said head member comprises a recording head for recording information from the sheet member.

3. A carriage mechanism according to claim 2, wherein said recording head comprises an ink jet recording head.

4. A cartridge mechanism according to claim 3, wherein said ink jet recording head has an electric-thermal converter for generating thermal energy to be used for discharging ink from an ink discharge opening.

5. A cartridge mechanism according to claim 1, wherein said vibration absorbing member achieves a noise reduction effect when a weight of said weight member is at least a few times but less than a few hundreds times a weight of said resilient member, and the noise reduction effect increases as the weight of said weight member increases until the weight reaches a predetermined value, said resilient member being a vibration preventing member capable of holding said weight member relative to said support member stably.

6. An apparatus having a carriage mechanism for moving a head member along a sheet member, said apparatus comprising:

control means for controlling the head member;

a carriage for holding the head member;

a belt member for moving said carriage in a moving direction;

a first pulley member for driving said belt member and being provided at one end of the carriage mechanism relative to the moving direction of said carriage;

a second pulley member for supporting said belt member at the other end of the carriage mechanism relative to the moving direction of said carriage;

a support member for supporting said second pulley member; and a vibration absorbing member for absorbing a vibration, said vibration absorbing member having a resilient member and a weight member, with said weight member being attached to said support member via said resilient member.

7. An apparatus according to claim 6, wherein said vibration absorbing member achieves a noise reduction effect when a weight of said weight member is at least a few times but less than a few hundreds times a weight of said resilient member, and the noise reduction effect increases as the weight of said weight member increases until the weight reaches a predetermined value, said resilient member being a vibration preventing member capable of holding said weight member relative to said support member stably.

8. An apparatus according to claim 6, wherein said head member comprises a recording head for recording information on the sheet member.

9. An apparatus according to claim 8 wherein said recording head comprises an ink jet recording head.

10. An apparatus according to claim 9, wherein said ink jet recording head has an electric-thermal converter for generating thermal energy to be used for discharging ink from an ink discharge opening.

11. A method for reducing noise of a belt member, said method comprising the steps of:

providing a carriage mechanism for moving a head member along a sheet member, the mechanism including a carriage for holding the head member, and also providing a belt member for moving the carriage in a moving direction, a first pulley member for driving the belt member and being provided at one end of the mechanism relative to the moving direction of the carriage, a second pulley member for supporting the belt member at the other end of the mechanism relative to the moving direction of the carriage, a support member for supporting the second pulley member, and a vibration absorbing member having a resilient member and a weight member, with the weight member being attached to the support member via the resilient member; and rotating the first pulley member to drive the belt member, wherein the resilient member and weight member of the vibration absorbing member reduce noise generated by the belt member.

* * * * *

UNITED STATES PATENT AND TRADEMARK OFFICE

CERTIFICATE OF CORRECTION

PATENT NO. : 5,595,448
DATED : January 21, 1997
INVENTOR(S) : Toshiaki HARADA

It is certified that error appears in the above-indentified patent and that said Letters Patent is hereby corrected as shown below:

On the title page, item:

[56] References Cited - FOREIGN PATENT DOCUMENTS:

"1176565 7/1989 Japan"
should read
--1-176565 7/1989 Japan--.

COLUMN 8:

Line 10, "the" should be deleted;
Line 36, "from" should read --on--.

COLUMN 9:

Line 18, "claim 8" should read --claim 8,--.

Signed and Sealed this
Fifteenth Day of July, 1997

Bruce Lehman

*Attest:*

BRUCE LEHMAN

*Attesting Officer*

*Commissioner of Patents and Trademarks*